United States Patent [19]

Rake et al.

[11] Patent Number: 4,776,065

[45] Date of Patent: Oct. 11, 1988

[54] FIBER SLIVER OR LAP EVENING APPARATUS FOR A CARDING MACHINE

[75] Inventors: Heinrich Rake, Aachen-Laurensberg; Wolfgang Wiening, Aachen, both of Fed. Rep. of Germany

[73] Assignee: Trützschler GmbH & Co. KG, Mönchengladbach, Fed. Rep. of Germany

[21] Appl. No.: 26,532

[22] Filed: Mar. 16, 1987

[30] Foreign Application Priority Data

Mar. 14, 1986 [DE] Fed. Rep. of Germany ..... 3608513

[51] Int. Cl.[4] ..... D01G 23/04; D01G 15/40; D01G 19/08

[52] U.S. Cl. ..... 19/105; 19/106 R; 19/240

[58] Field of Search ..... 19/105, 240, 106 R

[56] References Cited

U.S. PATENT DOCUMENTS

| | | | |
|---|---|---|---|
| 4,275,483 | 6/1981 | Roberson | 19/240 |
| 4,506,413 | 3/1985 | Leifeld | 19/240 X |

FOREIGN PATENT DOCUMENTS

| | | | |
|---|---|---|---|
| 2322942 | 4/1977 | France | 19/105 |
| 1265631 | 4/1968 | Fed. Rep. of Germany . | |
| 2050111 | 4/1971 | Fed. Rep. of Germany . | |
| 2359917 | 6/1974 | Fed. Rep. of Germany . | |
| 3205776 | 8/1983 | Fed. Rep. of Germany . | |

OTHER PUBLICATIONS

Handel, "Einführung in die Regelungstechnik", Textilindustrie 71, 4/1969, pp. 264–267.

Schäfer, "Allgemeine Grundlagen der Steuerung und Regelung", Melliand Textilberichte, pp. 665–667.

*Primary Examiner*—Louis K. Rimrodt

*Attorney, Agent, or Firm*—Spencer & Frank

[57] ABSTRACT

An apparatus for evening a fiber lap fed to a carding machine. The latter has a licker-in, a feed table and a feed roller cooperating with one another in feeding the fiber lap to the licker-in; a drive motor connected to the feed roller; and an arrangement providing for a relative movement of the feed roller and the feed table towards or away from one another as a function of the thickness of the fiber material passing therebetween. There is further provided an excursion measuring device for generating signals representing the magnitude of the relative movement; and a control device connected to the excursion measuring device. The control device is connected to the drive motor for regulating the rpm of the feed roller as a function of the relative motion between feed roller and feed table. A delay device is connected between the excursion measuring device and the control device for delaying transmittal of signals from the excursion measuring device to the control device. An angular displacement measuring device for generating signals corresponding to an angular displacement of the feed roller is connected to the delay device for varying the extent of delay of transmittal of signals by the delay device as a function of the signals generated by the angular displacement measuring device.

7 Claims, 5 Drawing Sheets

FIBER SLIVER OR LAP EVENING APPARATUS FOR A CARDING MACHINE

BACKGROUND OF THE INVENTION

The invention relates to an apparatus for evening the sliver or lap in a carding machine, a roller card unit or similar apparatus which has a licker-in (fiber opening roller), a feed roller arranged upstream of the licker-in as viewed in the direction of material feed and a feed table cooperating with the feed roller. Generally, the feed table is biased towards the stationarily supported feed roller and is arranged for shifting motion towards and away from the feed roller as a function of the thickness (quantity) of the fiber material passing through the clearance defined between the feed table and the feed roller. The feed table is associated with a measuring member for generating a signal representing the amount of excursion of the feed table.

In a known apparatus disclosed in French published application No. 2,322,942, underneath the stationary feed roller there is arranged a stationary support on which a plurality of sensor levers (feed table) are movably held. One end of the sensor levers is in the immediate vicinity of the licker-in and is spring loaded. The other end of each sensor lever is joined by a measuring device (sensor pedals) which responds to the shifts of the sensor lever as the latter moves as a function of the thickness of the fiber material passing through. The measuring location is the region between the feed roller and the feed table where the deviation of the thickness of the material is determined. In the prior art apparatus the measuring location is situated in the clamping zone between the feed roller and the sensor levers since the feed roller is immediately opposite the sensor levers. The measuring zone begins already at a location where the fiber material enters into the clamping gap. The working location is the zone where the fiber material is taken over by the licker-in. At that location, by virtue of an acceleration or deceleration of the rpm of the feed roller, lesser or greater quantities of fiber material are taken over by the licker-in and thus a correction (regulation) of the thickness deviation takes place. The time and path difference between measuring location and working location is a disadvantage because when at the measuring location a thickness deviation is sensed and by virtue of the control device the rpm of the feed roller is immediately altered, at the same moment at the working location (where the correction is supposed to take place) a correction of the material thickness is effected at a zone other than the intended region. When, conversely, the location of the fiber material to be corrected reaches the working zone, the feed roller, based on the further rpm changes that occur in the meantime, may have an rpm which cannot bring about the desired correction of the thickness deviation.

According to another known apparatus disclosed in U.S. Pat. No. 4,275,483, the feed roller is biased and is movably supported for a shifting motion relative to a stationary feed table as a function of the thickness of the introduced fiber material. The disadvantages relative to the measuring zone and the discrepancy between the measuring location and the working location which were discussed in connection with the prior art represented by French published application 2,322,942 are equally present in the prior art disclosed by the U.S. patent.

SUMMARY OF THE INVENTION

It is an object of the invention to provide an improved apparatus of the above-outlined type from which the discussed disadvantages are eliminated and which in particular makes possible a correction of the thickness variation of the fiber material at the working location corresponding to the thickness deviation determined at the measuring location.

This object and others to become apparent as the specification progresses, are accomplished by the invention, according to which, briefly stated, between the thickness measuring member and the control device connected to the feed roller motor a delay device is provided which is connected with a measuring device for the rpm or the angular displacement of the feed roller.

After a thickness deviation in the fiber material is determined at the measuring location, the delay device causes a certain time period to elapse before an rpm adjustment of the feed roller takes place, that is, the feed roller first rotates through a predetermined angle (which corresponds to the distance between the measuring location and the working location). Thus, only upon occurrence of the thickness variation at the working location will the rpm of the feed roller be altered to correct the thickness deviation. Dependent upon whether a thickened or reduced fiber portion reaches the working location, the rpm of the feed roller is accordingly increased or reduced so that more or less fiber material is taken over by the licker-in. This correction occurs with a delay relative to the determination of the thickness deviation at the measuring location. In this manner the correction of the thickness deviation of the fiber material is made possible at the working location corresponding to the thickness deviation determined at the measuring location. By virtue of the rpm variation of the feed roller the non-uniformities of the fiber material are removed slower or faster by the licker-in.

It is of importance that the measuring signal emitted by the measuring member causes the control device to react only after a delay which depends on the rpm of the feed roller.

According to an advantageous feature of the invention, between the measuring member and the control device a measuring value memory is provided. Advantageously, the delay device is connected with a measuring device for the rpm of the feed roller, for example, a tachogenerator for controlling the delay device. The tachogenerator may be associated with the feed roller whereby a direct determination of the feed roller rpm is effected. The tachometer may also be associated with the drive motor for the feed roller in which case an indirect measurement of the feed roller rpm is effected. Preferably, the delay device is connected with a measuring device for the feed roller rpm whose pulses are utilized for controlling the delay device. Expediently, as a measuring device a pulse signal triggering device is mounted on the feed roller and pulse signal generator is arranged stationarily. Advantageously, the feed roller is associated with an incremental angular displacement transmitter which serves for controlling the delay device. Preferably, the incremental angular displacement transmitter comprises a rotary slotted disc associated with the feed roller and a stationary sensor such as a photocell. According to a further preferred embodiment of the invention, the continuously operating drive motor for the feed roller comprises an rpm-variable d.c. motor.

DESCRIPTION OF THE PREFERRED EMBODIMENTS

Figure 1:
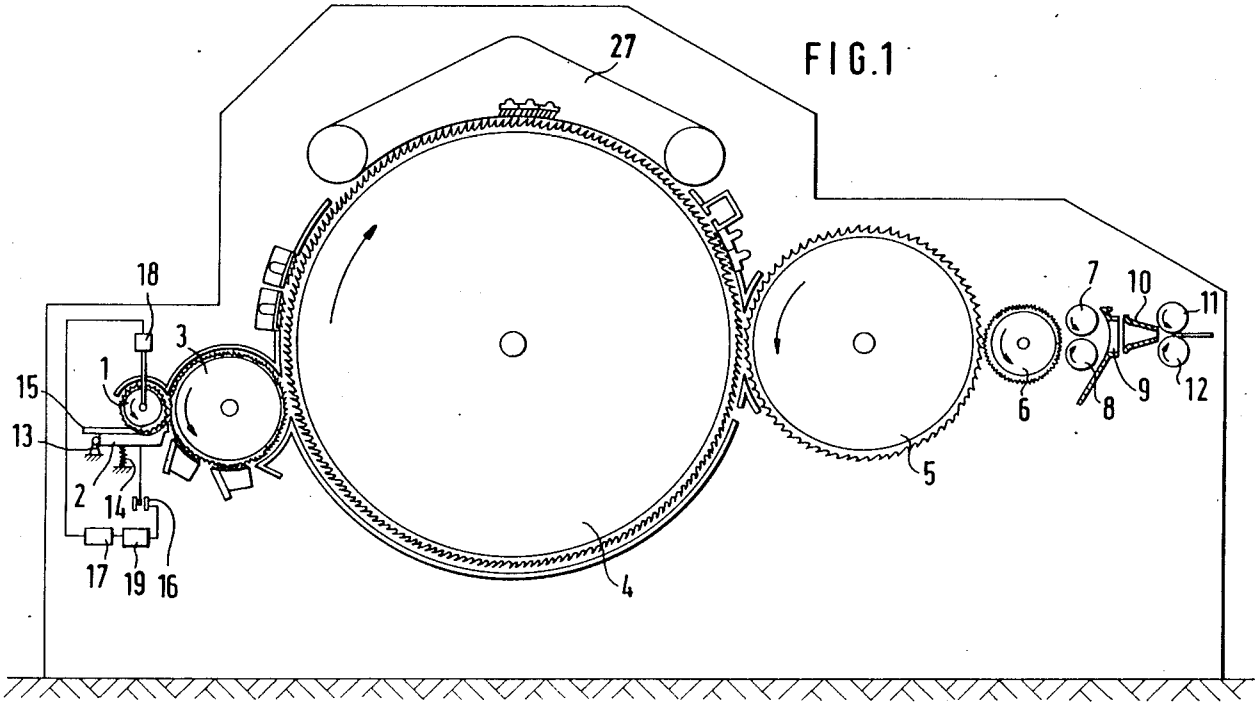
FIG. 1 is a schematic side elevational view of a carding machine incorporating the invention.

Turning to FIG. 1, there is illustrated therein a carding machine which may be an "EXACTACARD DK 715" model manufactured by Trützschler GmbH & Co. KG, Mönchengladbach, Federal Republic of Germany. The carding machine has a stationarily supported feed roller 1, a feed table 2, a licker-in 3, a main carding cylinder 4, a doffer 5, a stripper roller 6, crushing rollers 7 and 8, a web guiding element 9, a sliver trumpet 10, calender rollers 11 and 12 and travelling flats 27. The spring-biased feed table 2 is adapted to be displaced relative to the feed roller 1 as a function of the thickness (quantity) of the introduced fiber material 15. With the feed table 2 there is associated a measuring member 16 which senses the excursions of the feed table 2 and which is connected with a drive motor 18 for the feed roller 1 with the intermediary of a control device 17. Inasmuch as a thickness variation of the introduced fiber material 15—such as a reduction or an increase in thickness —occurs, the feed table 2 executes excursions which are sensed by the measuring member 16 and are transformed into an electric signal and applied to the control device 17 which causes the drive motor 18 of the feed roller 1 to accelerate or decelerate. A delay device 19 is arranged between the measuring member 16 and the control device 17.

Figure 2:
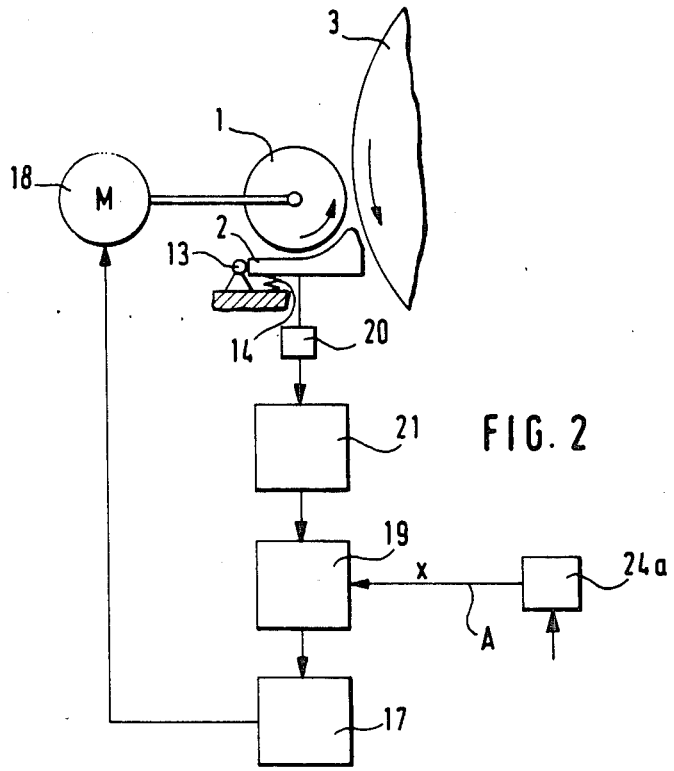
FIG. 2 is a schematic side elevational view, with block diagram, of a preferred embodiment of the invention.

Turning now to FIG. 2, the feed table 2 is supported by a stationary rotary bearing 13 and is biased by a compresion spring 14. With the feed table 2 there is associated a transducer 20 which transforms the excursions of the feed table 2 into electric signals which are applied to a measuring value memory 21 connected with the delay device 19. To the delay device 19 there is applied an electric signal x (as indicated by the arrow A) which is representative of the rpm of the feed roller 1. The signal x is emitted by a tachogenerator 24*a* which is associated with the drive motor 18 of the feed roller 1. An output of the delay device 19 is connected to the control device 17 which, in turn, is connected to the drive motor 18 of the feed roller 1.

Figure 3:
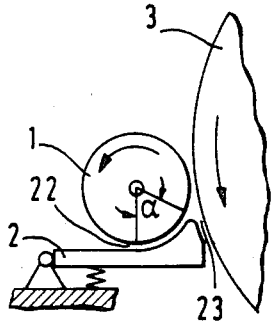
FIG. 3 is a schematic side elevational detail of the structure shown in FIG. 2.

Turning now to FIG. 3, there is shown a measuring location 22 in the clamping zone between the feed table 2 and the feed roller 1. Further, there is shown a working location 23 between the feed table 2 and the licker-in 3, that is, the location where the fiber material is transferred to the licker-in 3. The path and time difference between the measuring location 22 and the working location 23 are determined by the rotary angle $\alpha$ of the feed roller 1.

Figure 4:
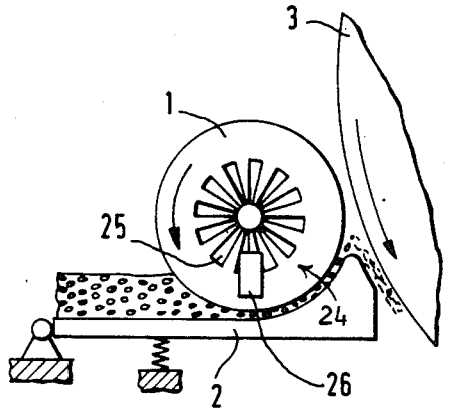
FIG. 4 is a further schematic side elevational detail of the structure shown in FIG. 2.

As shown in FIG. 4, with the feed roller 1 there is associated an incremental rotary (angular) displacement transmitter 24 which is formed of a rotary slotted disc 25 and a stationary sensor 26. The slotted disc 25 is affixed to one radial face of the feed roller 1 while the sensor 26 is arranged axially adjacent the slotted disc 25. The sensor 26 may be a photocell which senses interruptions of a light beam by the slotted disc 25.

Figure 5:
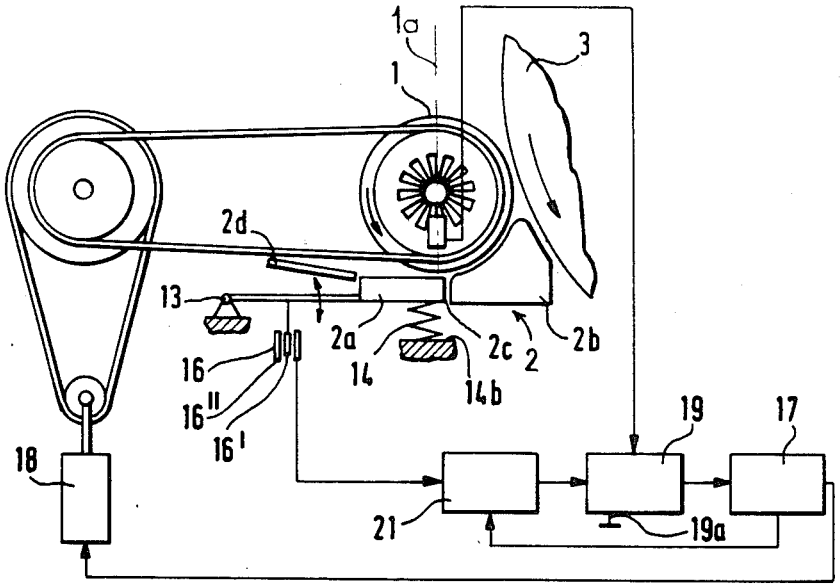
FIG. 5 is a schematic side elevational view, with block diagram, of another preferred embodiment of the invention.

Turning now to FIG. 5, the feed table 2 is formed of a movable first part 2*a* and a stationary second part 2*b*. The feed table 2 is thus divided, and its two parts 2*a* and 2*b* together define a throughgoing clearance 2*c*. The stationary part 2*b* is arranged between the licker-in 3 and the movable part 2*a*. That end of the stationary part 2*b* which is oriented towards the movable part 2*a* terminates at a short distance before a vertical axial diametral plane 1*a* of the feed roller 1, as viewed from the licker-in 3. The other end of the stationary part 2*b* extends into the clearance between the feed roller 1 and the licker-in 3. The movable part 2*a* is supported at one end by a stationary support 13. The other end of the movable part 2*a* oriented towards the stationary part 2*b* extends—as viewed from the rotary support 13—slightly beyond the vertical axial diametral plane 1*a* of the feed roller 1. The movable part 2*a* is biased by a compression spring 14 which at one end engages the underside of the movable part 2*a* and at the other end is in contact with a stationary countersupport 14*b*. A fiber guide element such as a sheet metal tray 2*d* guides the fiber lap onto the movable part 2*a* of the feed table 2. With the movable part 2*a* there is associated a measuring member 16, such as an inductive path sensor formed, for example, by a plunger armature 16′ and an inductive plunger coil 16″, constituting an inductive, contactless path sensor/-distance measurer. An output of the measuring member 16 is connected to a measuring value memory 21 which, in turn, is connected to a delay device 19. The output of the latter is connected to a control device 17 which is connected to the drive motor 18 of the feed roller 1. A device 19*a* serves for setting the extent of the delay.

Figure 6:
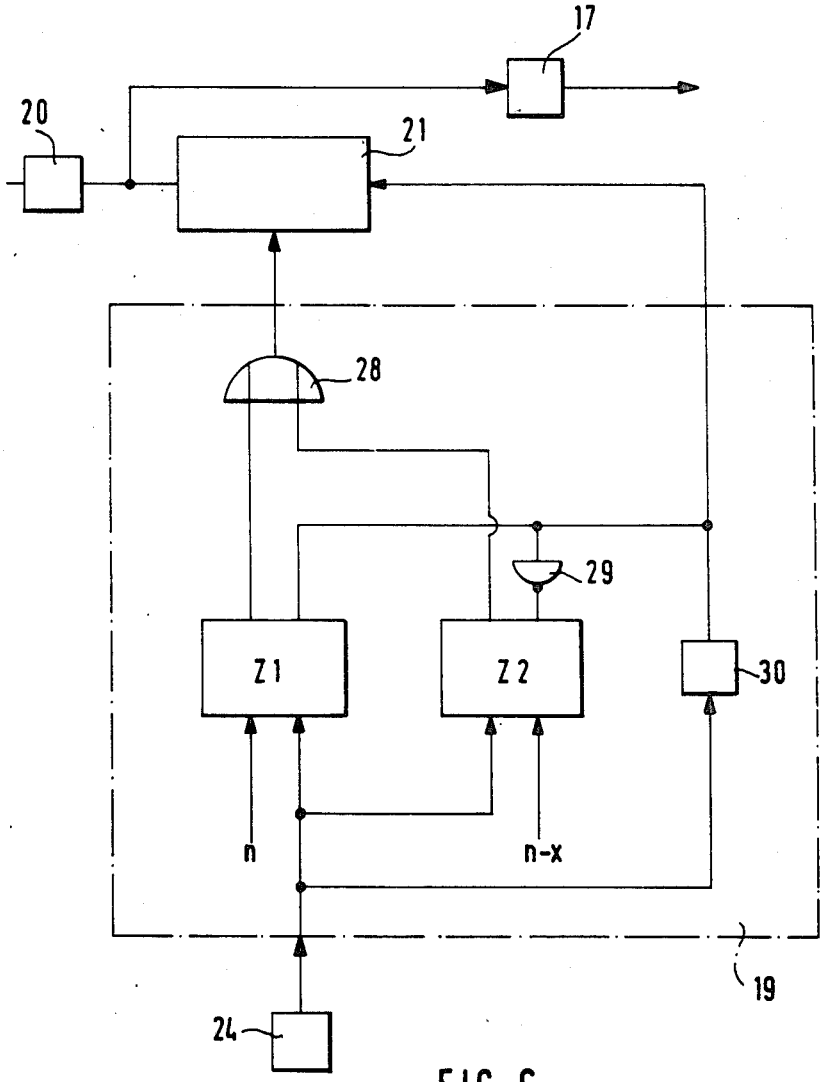
FIG. 6 is a block diagram of a circuit component shown in FIG. 5.

Turning to FIG. 6, there is shown a block diagram for the delay device 19. The rotary displacement indicator 24 is connected with the delay device 19, whose outputs are connected with the measuring value memory 21. Within the delay device 19 there are provided counters Z1 and Z2. A respective output of the counters Z1 and Z2 is connected to respective inputs of an OR-gate 28 whose output is applied to the measuring value memory 21. Respective outputs of the counters Z1 and Z2 are connected to a signal inverter 29. A device 30 forms pulses for storing the measuring values and effects the read/disc switchover. The rotary displacement transmitter 24 generates identical pulses for the counters Z1 and Z2. A delay is effected by applying different values (n and n−x) to the counters Z1 and Z2, for example, by means of a coding switch.

Figure 7:
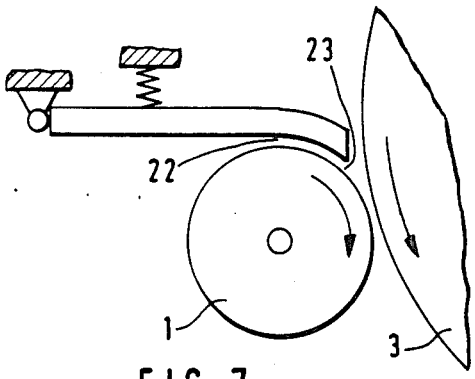
FIG. 7 is a schematic side elevational view of still another preferred embodiment of the invention.

FIG. 7 illustrates an embodiment in which the measuring location 22 and the working location 23 are situated above the feed roller 1. The electric processing of the signal associated with the thickness deviations of the material may be effected according to the circuit shown in FIG. 5 for varying the feed roller rpm.

Figure 8:
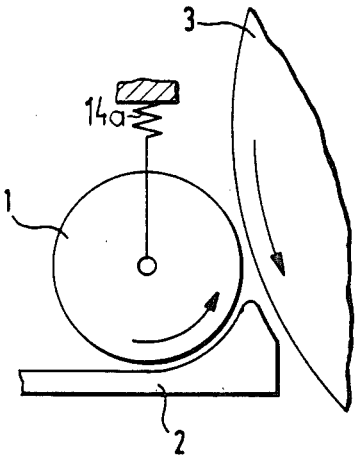
FIG. 8 is a schematic side elevational view of yet another preferred embodiment of the invention.

As illustrated in FIG. 8, the invention may find application in a fiber feed arrangement which has a shiftably supported feed roller 1 and a stationary feed table 2. The feed roller 1 is movably supported by springs 14*a* and, by excursions, determines thickness deviations in the fiber material which is momentarily located in the clamping clearance between the feed roller 1 and the feed table 2. The electric processing of the signals corresponding to the thickness variations may be carried out by the circuit shown in FIG. 5 for varying the feed roller rpm.

The direction of rotation of the rollers of the carding machine is shown by arrows drawn into the roller components in FIGS. 1–5, 7 and 8. While the invention was described in connection with a carding machine, it will be understood that it may equally find application in similar apparatus such as roller card units, beaters, cleaners and the like.

The present disclosure relates to subject matter contained in Federal Republic of German Patent Application No. P 36 08 513.8 (filed Mar. 14, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an apparatus for evening a fiber lap fed to a carding machine having a licker-in, a feed table and a feed roller cooperating with one another in feeding the fiber lap to the licker-in and being situated upstream of the licker-in as viewed in a direction of lap advance; a drive motor connected to said feed roller for rotating said feed roller; means providing for a relative movement of said feed roller and said feed table towards or away from one another as a function of the thickness of the fiber material passing between the feed roller and the feed table; excursion measuring means for generating signals representing amplitudes of said relative movement; a control device being connected to said excursion measuring means for receiving said signals from said excursion measuring means; said control device being operatively connected to said drive motor for regulating the rpm of said feed roller as a function of said signals; the improvement comprising (a) delay means connected between said excursion measuring means and said control device for delaying transmittal of said signals from said excursion measuring means to said control device; and (b) angular displacement measuring means for generating signals corresponding to an angular displacement of said feed roller; said angular displacement measuring means being connected to said delay means for varying the extent of delay of transmittal of signals by said delay means as a function of the signals generated by said angular displacement measuring means.

2. An apparatus as defined in claim 1, further comprising a measuring value memory connected to said excursion measuring means and said control device for receiving signals from said excursion measuring means and said control device.

3. An apparatus as defined in claim 1, wherein said angular displacement measuring means comprises a tachogenerator.

4. An apparatus as defined in claim 1, wherein said angular displacement measuring means comprises a pulse triggering device mounted on said feed roller for rotation therewith as a unit and a stationarily supported detector operatively connected to said pulse triggering device for receiving signals from said pulse triggering device.

5. An apparatus as defined in claim 1, wherein said angular displacement measuring means comprises an incremental angular displacement indicating device.

6. An apparatus as defined in claim 5, wherein said incremental angular displacement indicating device includes a slotted disc arranged for rotation in unison with said feed roller and a stationarily supported detector operatively connected to said slotted disc for receiving signals therefrom.

7. An apparatus as defined in claim 1, wherein said drive motor is an rpm-variable d.c. motor.

* * * * *